United States Patent [19]

Sjoman

[11] 4,037,386

[45] July 26, 1977

[54] METHOD OF FOLDING AND ROLLING BRIEFS

[75] Inventor: Carl F. Sjoman, Los Angeles, Calif.

[73] Assignee: Team Industries, Los Angeles, Calif.

[21] Appl. No.: 666,866

[22] Filed: Mar. 15, 1976

Related U.S. Application Data

[62] Division of Ser. No. 501,693, Aug. 29, 1974, Pat. No. 3,965,647.

[51] Int. Cl.[2] ..... B65B 63/04

[52] U.S. Cl. ..... 53/21 FW

[58] Field of Search ..... 53/21 FW, 117; 206/278, 206/286, 287; 223/37

[56] References Cited

U.S. PATENT DOCUMENTS

| | | | |
|---|---|---|---|
| 3,237,363 | 3/1966 | Spohr | 53/21 FW |
| 3,448,557 | 6/1969 | Swaithes | 53/117 |

*Primary Examiner*—Travis S. McGehee

*Attorney, Agent, or Firm*—Harris, Kern, Wallen & Tinsley

[57] ABSTRACT

A packaged man's brief, or similar article, comprising a brief folded and rolled into a substantially cylindrical configuration, and a bag enclosing the folded and rolled brief. A method and apparatus for packaging a brief, comprising making transverse and spaced, parallel longitudinal folds in the brief around a card, then rolling the brief into a substantially cylindrical configuration with the waistband of the brief at one end, and finally inserting the folded and rolled brief into a bag with the waistband end first.

2 Claims, 41 Drawing Figures

METHOD OF FOLDING AND ROLLING BRIEFS

This is a division of application Ser. No. 501,693, filed Aug. 29, 1974, now U.S. Pat. No. 3,965,647.

BACKGROUND OF INVENTION

The present invention relates generally to the art of folding and/or packaging articles, and especially fabric articles.

More particularly, the invention relates to the garment folding and/or packaging art, and specifically to the folding and/or packaging of mens's briefs, or similar articles.

OBJECTS AND SUMMARY OF INVENTION

The primary object of the invention is to provide a method and apparatus for folding, rolling and packaging a man's brief, the only manual operation being required being insertion of the brief into the apparatus at its inlet end.

An important object of the invention is to provide a packaged man's brief which is folded and rolled into a substantially cylindrical configuration and encased in a bag, the latter preferably being at least partially transparent, and formed of a suitable plastic.

More particularly, an important object is to provide a method and apparatus of packaging a man's brief which involve folding and rolling the brief into a substantially cylindrical configuration with the waistband at one end, and then inserting the folded and rolled brief into a bag with the waistband end being inserted first.

A further important object is to provide means for rolling the folded brief tightly into a small-diameter cylindrical configuration, i.e., a diameter considerably less than can be achieved by hand, so that a smaller-than-normal bag can be used to minimize bag costs.

An object in connection with the folding operation is to fold the brief transversely first, and then fold it longitudinally along a plurality of laterally spaced, longitudinal fold lines.

More particularly, an object of the invention is to provide a method and apparatus for packaging a man's brief, which involve: folding the brief transversely thereof; folding the transversely folded brief longitudinally thereof along laterally spaced, longitudinal fold lines; rolling the transversely and longitudinally folded brief into a substantially cylindrical configuration having an axis substantially parallel to the longitudinal fold lines and with the waistband of the brief at one end of the cylindrical configuration; opening a bag into which the folded and rolled brief is to be inserted; inserting the folded and rolled brief into the opened bag; and subsequentially closing the open end of the bag, as by heat sealing.

Another important object of the invention is to provide a method and apparatus which involve folding the brief longitudinally thereof along laterally spaced, longitudinal fold lines, with opposite edges of the brief being folded along such longitudinal fold lines sequentially.

Another object is to provide a folding apparatus having a folding means which includes laterally spaced, longitudinal folding blades respectively engageable with the brief adjacent opposite longitudinal edges thereof, and means for pivoting the folding blades sequentially about laterally spaced, longitudinal axes, and inwardly toward each other.

The invention may be further summarized as including, and an important object is to provide a folding means which includes: laterally spaced, longitudinal rods engageable by the brief adjacent opposite longitudinal edges thereof; laterally spaced, longitudinal folding blades carried by the respective rods; and means for pivoting the rods and the folding blades sequentially about the respective rod axes.

Summarizing the invention is still more detail, the folding means includes two rod mounting means respectively carrying the rods and swingable inwardly toward each other about laterally spaced, longitudinal axes located laterally inwardly of the rod axes prior to folding of the brief, and means for sequentially swinging the rod mounting means inwardly, and for pivoting the rods and the folding blades relative to their respective mounting means in the same sequence.

The invention may be still further summarized as comprising a folding means which includes laterally spaced, longitudinal spring clips respectively engageable with the rods, the brief being manually insertable between such spring clips and the rods.

Summarizing the invention even further, an important object is to provide a folding and packaging apparatus for men's briefs which includes: a Ferris-wheel-like structure rotatable about a horizontal axis and having circumferentially spaced, radially extending folding units each movable through a card receiving station, a brief receiving station circumferentially spaced from the card receiving station, a first brief folding zone circumferentially spaced from the brief receiving station, a second brief folding zone circumferentially spaced from the first brief folding zone, and a folded brief discharge station circumferentially spaced from the second brief folding zone; each of the brief folding units having card holding means for receiving a card at the card receiving station, brief holding means for receiving a brief at the brief receiving station, gravity actuated means for making a transverse fold in the brief in the first brief folding zone, and means for making laterally spaced, longitudinal folds in the transversely folded brief in the second brief folding zone; means for feeding a card to the card holding means of each folding unit at the card receiving station; the brief holding means of each of the folding units being adapted to receive a manually inserted brief at the brief receiving station; means for discharging the transversely and longitudinally folded brief at the brief discharge station; means adjacent the folded brief discharge station for rolling the transversely and longitudinally folded brief substantially into a cylinder having an axis substantially parallel to the longitudinal folds in the brief; and means for inserting the folded and rolled brief into an open end of a bag with the waistband end of the folded and rolled brief being inserted first.

A further important object of the invention is to provide a folding apparatus wherein each folding unit or means incorporates means for folding a brief around itself, and wherein the folding apparatus includes means for extracting the folded brief from the following unit or means.

Yet another important object of the invention is to provide an apparatus wherein the extracting means also performs the function of rolling the folded brief into a substantially cylindrical configuration, and comprises: two laterally spaced, substantially parallel shafts which are positionable on opposite sides of the folding unit, which are rotatable, and which are movable laterally toward and away from each other; a flexible web extending between the shafts and having lateral edges respectively secured to the shafts, the web being adapted to engage the folded brief on the folding unit; means for rotating the shafts in opposite directions, with the web in engagement with the folded brief, so as to wind the lateral edge portions of the web on the shafts; means for simultaneously swinging the shafts toward each other to wrap the web around the folded brief on the folding unit; and means for moving the extracting means relative to the folding unit to extract the folded brief therefrom.

An important object related to the foregoing is to provide an apparatus for rolling an article into a substantially cylindrical configuration, comprising: two laterally spaced, substantially parallel shafts which are rotatable and which are movable laterally toward and away from each other; a flexible web extending between the shafts and having lateral edges respectively secured to the shafts, the web being adapted to receive thereon an article to be rolled; means for rotating the shafts in opposite directions with the article on the web, so as to wind the lateral edge portions of the web on the shafts; means for simultaneously moving the shafts toward each other; and whereby the article is rolled into the desired substantially cylindrical configuration by the web as the lateral edge portions are wound onto the shafts and as the shafts are moved toward each other.

Summarizing another aspect of the invention, an important object is to provide an apparatus for folding, rolling and packaging a man's brief, comprising: a central folding means for folding the brief; two laterally spaced bagging means respectively disposed on opposite sides of the folding means; two laterally spaced brief extracting and rolling means for extracting a folded brief from the folding means, for rolling same into a substantially cylindrical configuration, and for inserting the folded and rolled brief into bags at the bagging stations; the extracting and rolling means being laterally spaced apart a distance equal to the lateral spacing of each of the bagging means from the folding means; and the extracting and rolling means being laterally shiftable between a first position wherein one of the extracting and rolling means is aligned with the folding means and the other is aligned with one of the bagging means, and a second position wherein the one extracting and rolling means is aligned with the other of the bagging means and the other extracting and rolling means is aligned with the folding means, the extracting and rolling means also being longitudinally movable toward and away from the folding and bagging means.

The foregoing objects, advantages, features and results of the present invention, together with various other objects, advantages, features and results thereof which will be evident to those skilled in the art to which the invention relates in the light of this disclosure, may be achieved with the exemplary embodiments of the invention illustrated in the accompanying drawings and described in detail hereinafter.

DESCRIPTION OF EXEMPLARY EMBODIMENT OF INVENTION

Figure 1:
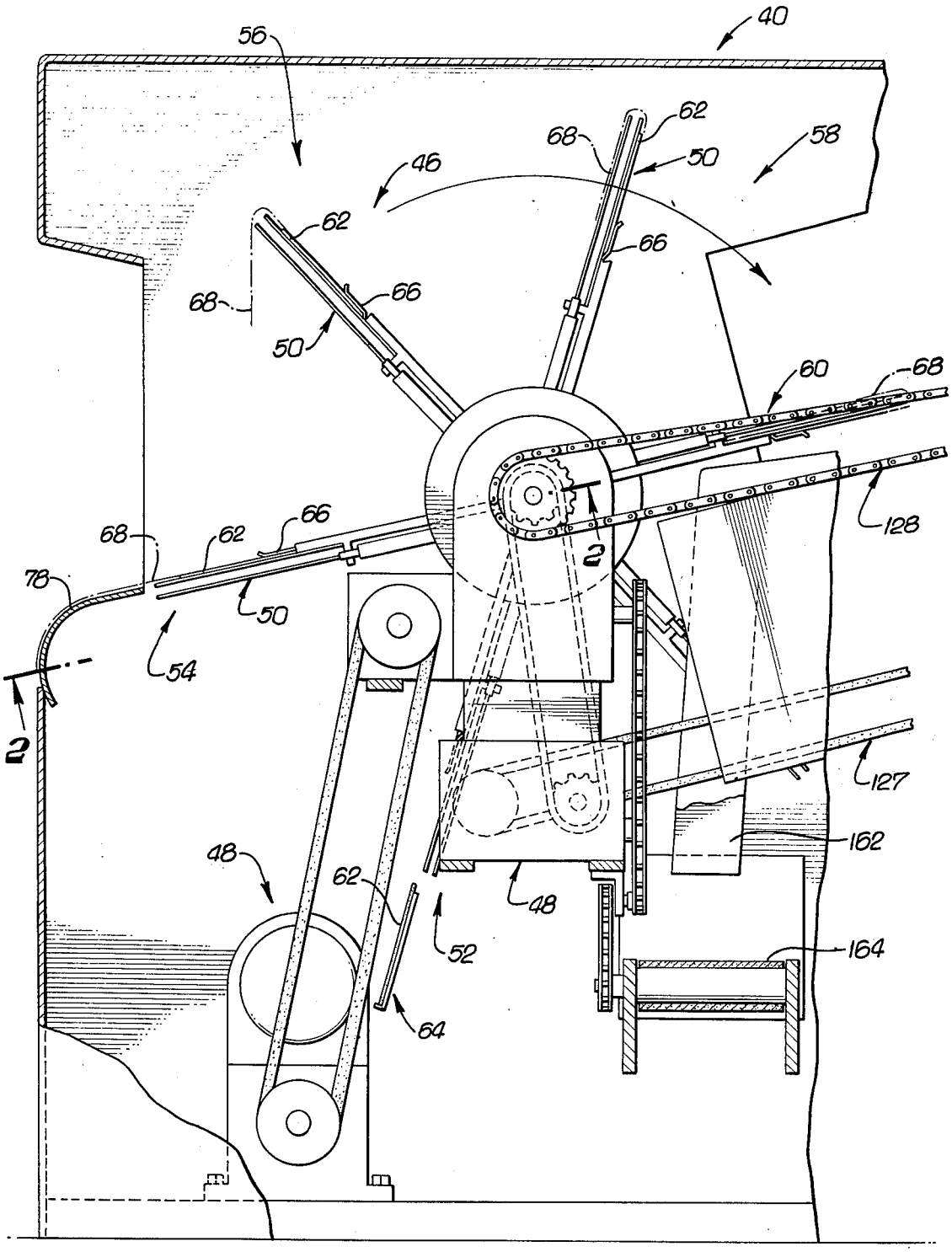
FIG. 1 is a view, partially in side elevation and partially in vertical section, showing a brief folding apparatus which constitutes the inlet end of the over-all brief folding, rolling and packaging apparatus or system of the invention.

The brief folding, rolling and packaging apparatus or system of the invention includes as its major components: a folding apparatus 40, FIG. 1, for folding a man's brief, or similar article, transversely and then longitudinally into a compact box-like configuration into which the crotch portion and the longitudinal side or edge portions of the brief are tucked; an apparatus 42, FIGS. 18 to 39, for extracting the folded brief from the folding apparatus 40 and for rolling the folded brief from the folding apparatus 40 and for rolling the folded brief into a substantially cylindrical configuration with the axis of the cylinder paralleling the longitudinal fold lines; and an apparatus 44, e.g., FIGS. 19, 27, 32, 35 and 37, for packaging the folded and rolled brief by inserting same into a bag waistband-end first, and then closing the open end of the bag, as by heat sealing, the bag preferably being at least partially transparent and preferably being formed of a heat sealable plastic.

The foregoing general components 40, 42 and 44 of the over-all apparatus or system of the invention will be considered hereinafter under corresponding subheadings.

Folding Apparatus 40

Referring to FIGS. 1 to 17 of the drawings, and initially to FIG. 1 thereof in particular, the folding apparatus 40 includes as its major component a Ferris-wheel-like folding structure 46 indexable in a step-by-step manner about a horizontal axis and driven by a suitable drive means 48. The folding structure 46 includes a plurality of circumferentially spaced, radially extending, spoke-like folding means or units 50 successively movable through a card receiving station 52, a brief receiving station 54 circumferentially spaced from the card receiving station, a first brief folding zone 56 circumferentially spaced from the brief receiving station, a second brief folding zone circumferentially spaced from the first, and a folded brief discharge or extraction station 60 circumferentially spaced from the second brief folding zone, the extraction station being shown as substantially diametrically opposite the brief receiving station 54.

At the card receiving station 52, chip board cards 62, or the like, are inserted into successive ones of the folding units 50 by a card feeding means 64 of any suitable construction. Each such card 62 is inserted into a spring-clip holding means 66 forming part of the corresponding folding unit 50.

At the brief receiving station 54, each folding unit 50 receives a man's brief, or the like, 68 which is manually inserted waistband-end 70 first into a spring clip holding means 72 forming part of each folding unit 50.

Figure 17:
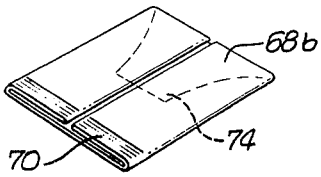
FIG. 17 is a view showing a completely folded small brief, and corresponds to FIG. 14.

As each folding unit 50 traverses the first brief folding zone 56, the brief 68 carried thereby is transversely folded by gravity to tuck the crotch portion 74 of the brief inwardly. As each transversely folded brief 68 passes through the second brief folding zone 58 by the corresponding folding unit 50, its longitudinal side or edge portions are folded inwardly in either of the ways shown in FIGS. 10 to 12 and in FIG. 17, FIGS. 10 to 12 showing the longitudinal folding of a large-size brief 68*a* and FIG. 17 showing the folding of a small-size brief 68*b*. The manners in which large or small briefs 68*a* or 68*b* are longitudinally folded will be considered in more detail hereinafter.

Finally, at the discharge or extraction station 60, each transversely and longitudinally folded brief 68 is removed from the corresponding folding unit 50 by an exracting and rolling means 76 forming part of the overall extracting and rolling apparatus 42.

Figure 2:
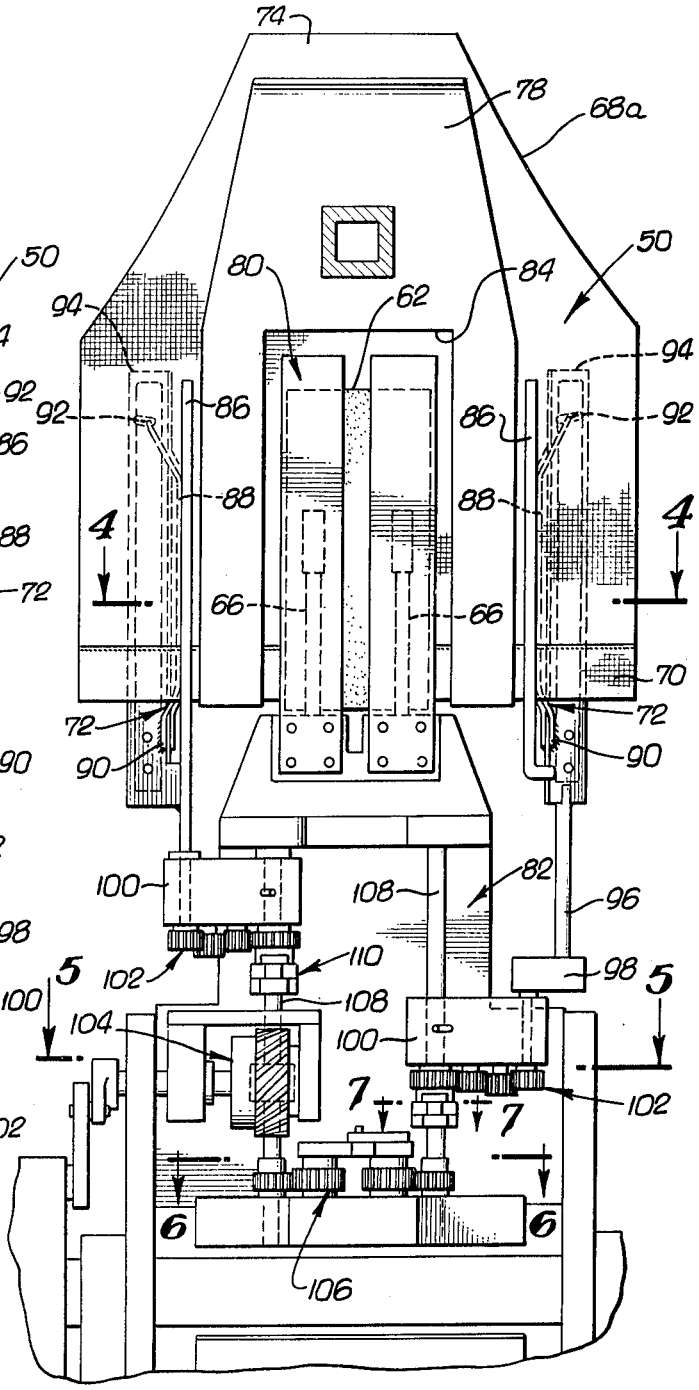
FIG. 2 is an elevational view of a folding means or unit of the invention, taken as indicated by the arrowed line 2—2 of FIG. 1, showing folding blades of the unit in their laterally outer positions.

Turning now to FIG. 2 of the drawings, illustrated therein is one of the folding units 50 at the brief receiving station 54, the folding unit in question being in register with a brief receiving apron 78 (also see FIG. 1) on which the brief to be folded is placed as it is manually inserted into the folding unit. As will be clear from FIG. 2, the apron 78 and the folding units 50 are so constructed that each folding unit can pass the apron without interference. It will be understood that each brief is inserted into a folding unit 50 waistband-end first.

As the waistband end of the brief is inserted into a particular folding unit 50, it rests on the corresponding card 62, which, in turn, rests on underlying supporting means 80 carried by a frame 82 of the folding unit. The supporting means 80 is shown as comprising two radially extending, axially spaced plates adapted to pass through a notch 84 in the apron 78.

Figure 4:
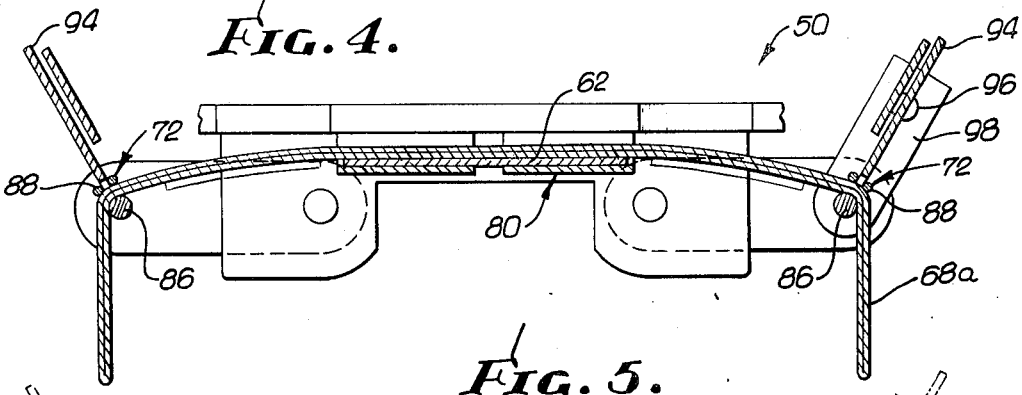
FIG. 4 is a transverse sectional view through one of the folding units and is taken as indicated by the arrowed line 4—4 of FIG. 2.

When a brief is inserted into one of the folding units 50 at the brief receiving station 54, the brief engages laterally spaced, longitudinal rods 86 adjacent opposite longitudinal edges of the brief, as shown in FIGS. 2 and 4. (As used here, the term longitudinal means radial with respect to the Ferris-wheel-like folding structure 46, and the term lateral means axial with reference to such folding structure.) The brief is inserted waistband-end first between the rods 86 and laterally spaced, longitudinal spring clips 88 respectively engageable with the rods. Each spring clip, which is U shaped, is cantilevered, having a fixed end 90 and a free end 92 movable toward and away from the corresponding rod to facilitate insertion of the brief.

Figure 10:
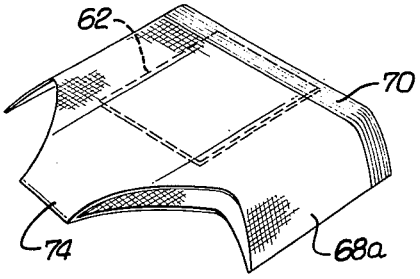
FIGS. 10, 11 and 12 show a brief in various stages of being folded, FIG. 10 corresponding to FIG. 4, FIG. 11 corresponding to FIG. 8, and FIG. 12 corresponding to FIG. 9.
Figure 11:
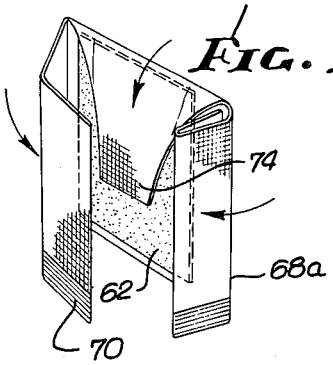

As will be clear from FIG. 4 in particular, the longitudinal edges of a large brief 68*a* hand from the rods 86 as the folding unit 50 in question moves from the brief receiving station 54 to the first brief folding zone 56. Also, as the brief moves through the first brief folding zone 56, the crotch portion 74 folds downwardly over the outer end of the supporting means 80 by the action of gravity. FIG. 10 also illustrates the manner in which the longitudinal edge portions of the brief depend, and FIG. 11 illustrates the manner in which the crotch portion 74 is transversely folded.

Connected to the respective rods 86 are laterally spaced, longitudinal folding blades 94 which, as will be described, fold the longitudinal edge portions of the brief 68*a* inwardly toward each other in the manner illustrated in FIG. 11. The folding blades 94 are sequentially pivoted and swung inwardly toward each other about laterally spaced, longitudinal axes as shown in the successive position views of FIGS. 4, 8 and 9. The end result, as shown in FIG. 9, is that the brief 68*a* is, in effect, wrapped around the corresponding folding unit 50, with the crotch portion 74 tucked between the double-folded longitudinal edge portions of the brief and the body of the brief. This relationship of the transversely folded crotch portion 74 and the double-longitudinal-folded edge portions to the card 62 will be clear from FIG. 11 in particular.

Figure 3:
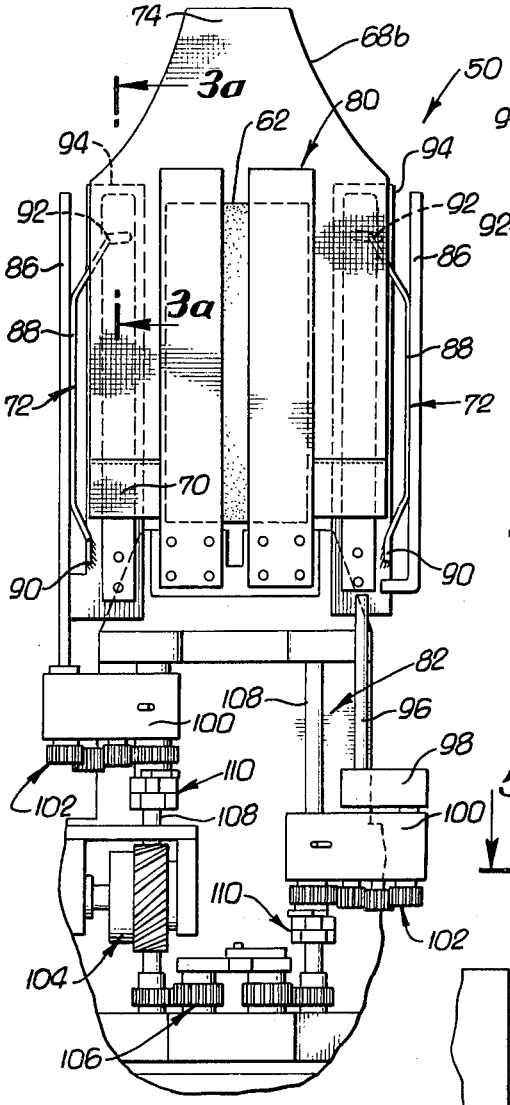
FIG. 3 is a view similar to FIG. 2, but showing the folding blades displaced laterally inwardly from the positions shown in FIG. 2.
Figure 3A:
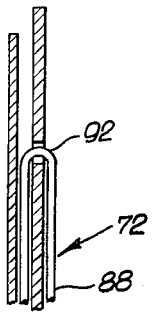
FIG. 3*a* is a fragmentary sectional view taken as indicated by the arrowed line 3*a*—3*a* of FIG. 3.

As viewed in FIG. 2, the right rod 86 and folding blade 94 are mounted on a shaft 96 the axis of which is offset from the axis of the corresponding rod 86. The shaft 96 is mounted on a crank 98 the axis of which coincides with the axis of the corresponding rod 86. The crank 98 is positionable either as shown in FIG. 2 for a large brief 68*a,* or as shown in FIG. 3 for a small brief 68*b.*

Each folding unit 50 includes two rod mounting means 100 respectively carrying the rods 86 and swingable inwardly toward each other about laterally spaced, longitudinal axes located laterally inwardly of the rod axes prior to folding of the brief. Connected to the rod mounting means 100 are drive trains 102 which serve to swing the rods 86 inwardly toward each other as described, the right drive train 102, as viewed in FIGS. 2 and 3, also serving to pivot the crank 98. The two drive trains 100 are connected to a drive means 104, the right drive train 102 through another drive train 106.

Figure 8:
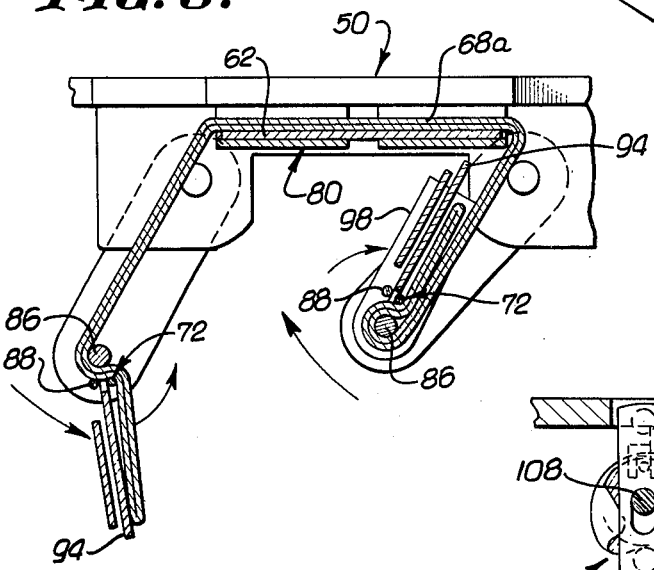
FIG. 8 is a view similar to FIG. 4, but showing various parts of the folding unit in different operating positions, such parts being shown in their positions prior to folding in FIG. 4, and being shown in FIG. 8 in positions wherein the brief is nearly completely folded.
Figure 9:
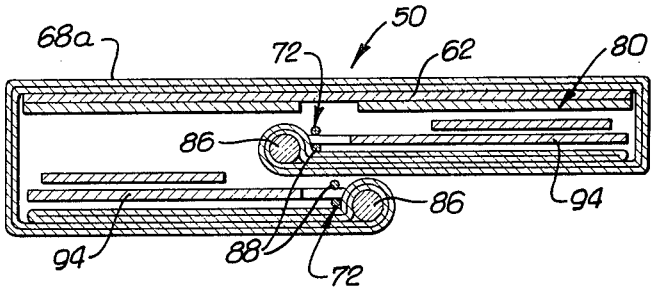
FIG. 9 is a view similar to FIG. 8, but showing parts of the folding unit in positions corresponding to complete folding of the brief.
Figure 12:
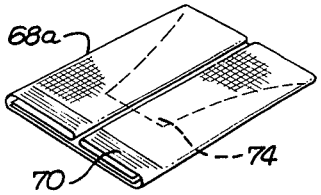

Considering the longitudinal folding of a large brief 68*a,* the foregoing drive system, constituting the drive trains 102 and 106 and the drive means 104, sequentially pivots the folding blades 94 inwardly toward each other, and swings them inwardly toward each other, in the manner successively shown in FIGS. 4, 8 and 9, the right rod 86 and the folding blade 94 moving inwardly first, followed by the left rod 86 and folding blade 94, the final folded configuration being as shown in FIG. 9. which corresponds to the final folded configuration of FIG. 12.

Figure 13:
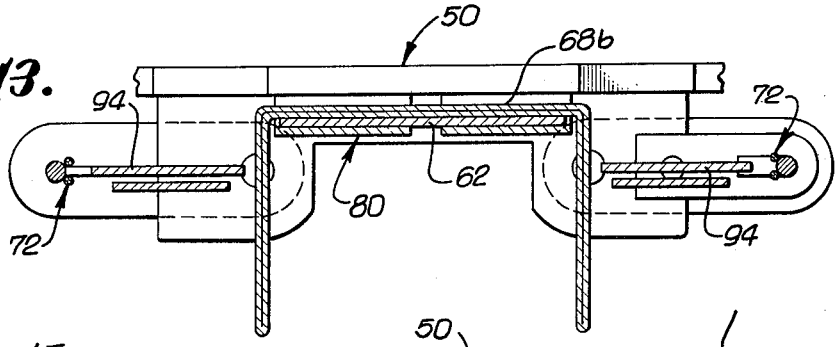
FIG. 13 is a view similar to FIG. 4, but showing a folding unit of the invention in use to fold a small, i.e., small size, brief, FIG. 4 showing the folding of a large brief.

Before beginning the longitudinal folding of a large brief 68*a,* the folding blades 94 and the crank 98 are positioned as shown in FIGS. 2 and 4 of the drawings. When folding a small brief 68*b,* the longitudinal edges of such small brief are merely permitted to depend from the card 62 and the underlying supporting structure 80, as shown in FIGS. 3 and 13. The folding blades 94 and the crank 98 are positioned correspondingly differently, as also shown in FIGS. 3 and 13. With a small brief 68*b,* edge portions of such brief are not inserted between the rods 86 and the spring clips 88.

Figure 14:
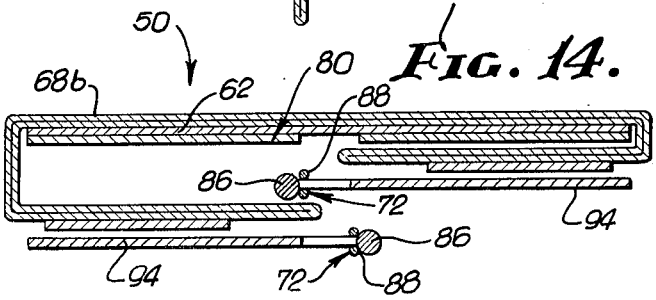
FIG. 14 is a view similar to FIG. 9, but showing a completely folded small brief.

The operation of a folding unit 50 in folding a small brief 68*b* is generally similar to the operation in folding a large brief, in the sense that opposite longitudinal edges are folded sequentially with the crotch portions 74 tucked between the longitudinally folded edge portions and the body portion, as shown in FIG. 17. The final positions of the folding blades 94, when folding a small brief 68*b,* are as shown in FIG. 14. As in the case of the large brief 68*a,* the transversely and longitudinally folded small brief 68*b* is wrapped around the folding unit 50 in the final, folded condition.

Figure 5:
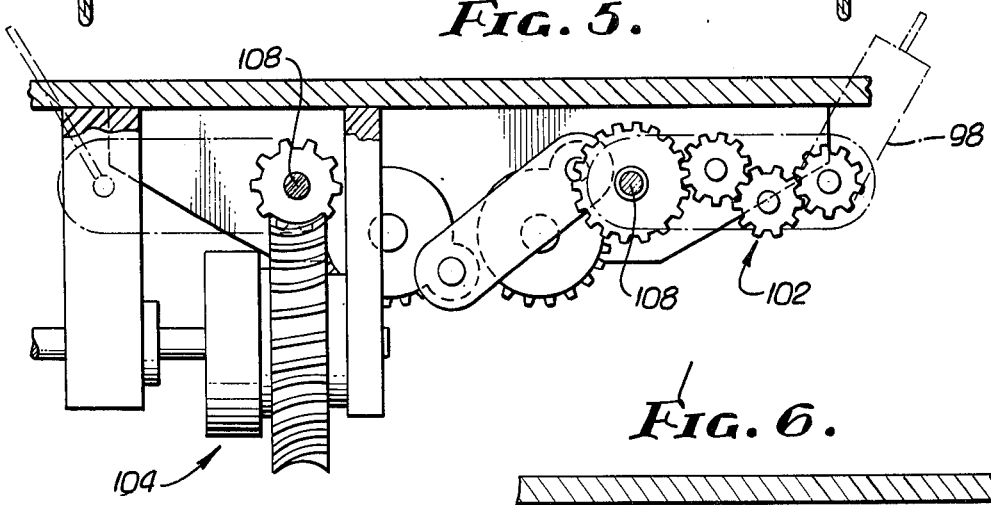
FIGS. 5, 6 and 7 are sectional views respectively taken as indicated by arrowed lines 5—5, 6—6 and 7—7 of FIG. 2.
Figure 6:
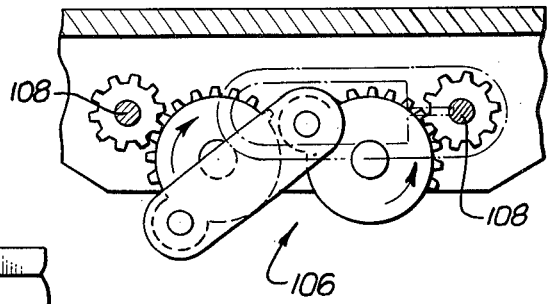

The two mounting means 100 are respectively pivotable about the axes of laterally spaced, longitudinal drive shafts 108 respectively interconnecting the drive train 106 and the two drive trains 102, one of the drive shafts 108 being driven by the driving means 104, as best shown in FIGS. 2, 3 and 5.

Figure 15:
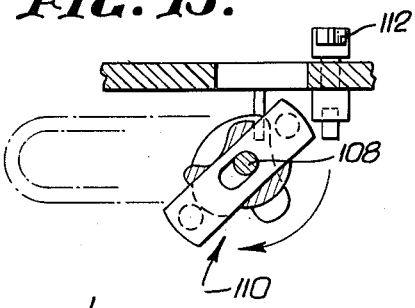
FIGS. 15 and 16 are fragmentary sectional views similar to FIG. 7, but showing positions of various parts corresponding to folding of a small brief, instead of a large brief.
Figure 16:
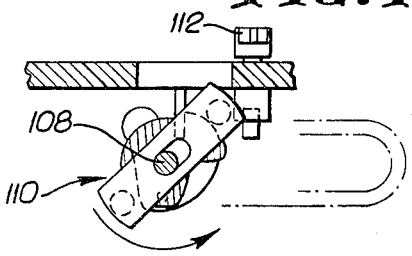
Figure 18:
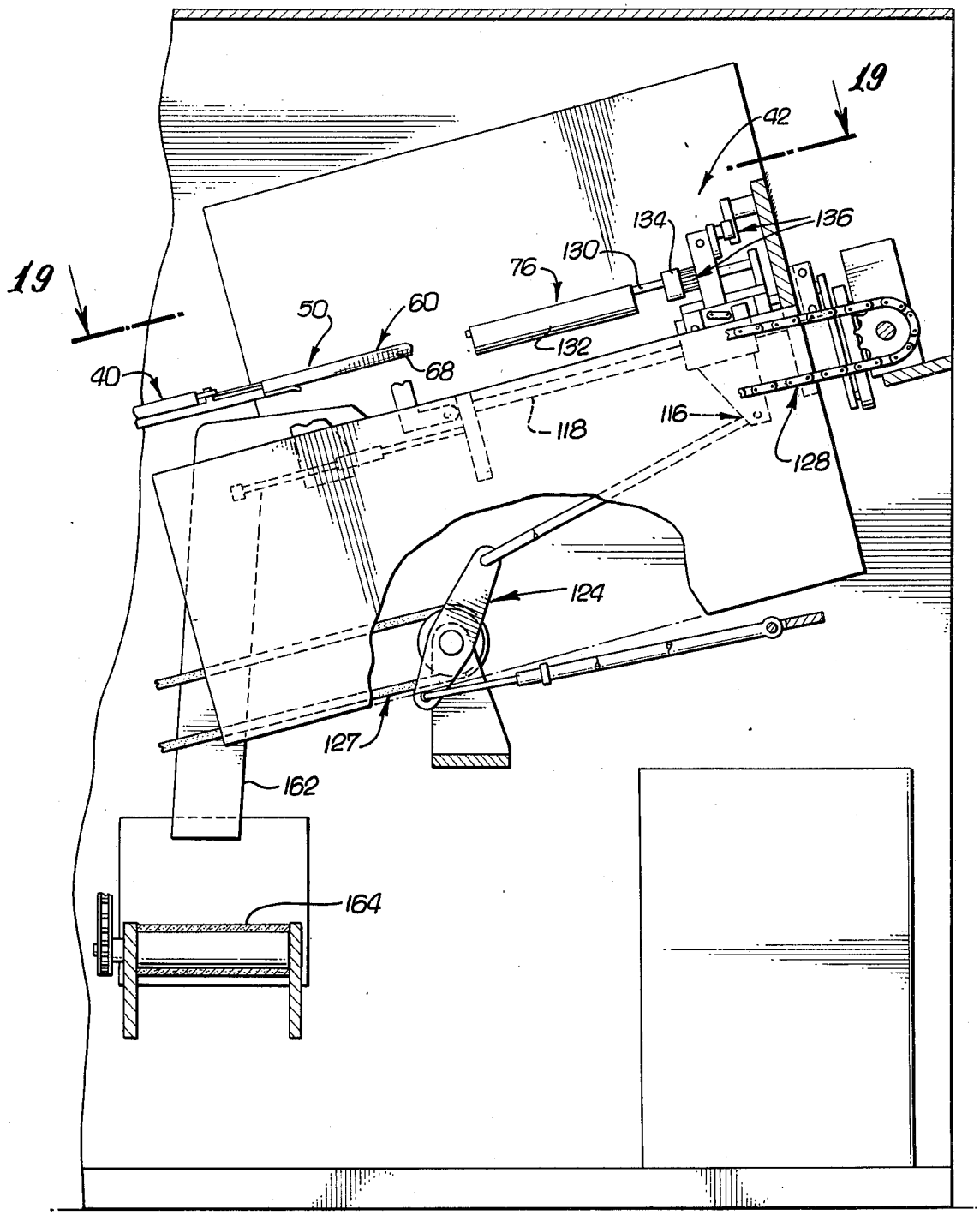
FIG. 18 is a view, partially in side elevation and partially in vertical section, showing a folded brief extracting, rolling and packaging means of the invention located at the discharge end of the over-all folding, rolling and packaging system.
Figure 20:
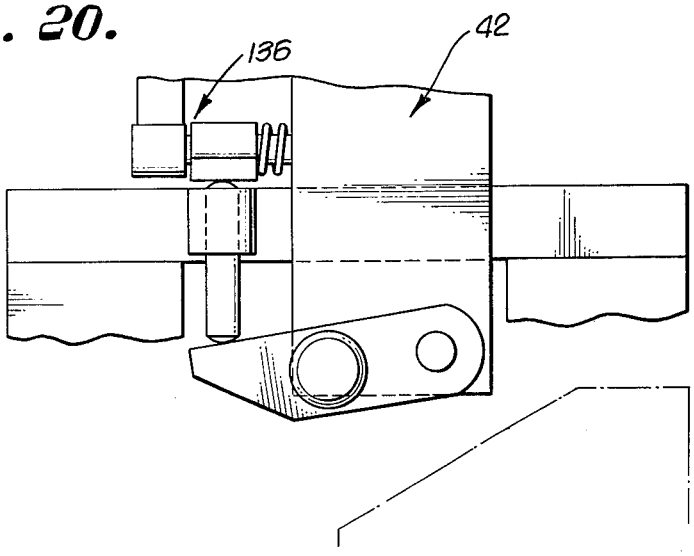
FIG. 20 is an enlarged, fragmentary elevational view taken as indicated by the arrowed line 20—20 of FIG. 23.

Interposed in each drive shaft 100 is a manually adjustable connecting mechanism 110, FIGS. 2, 3, 7, 15 and 16, by means of which the angular position of the corresponding drive train 102 and rod mounting means 100 can be adjusted to achieve either the large-brief folding blade positions of FIG. 2 (to which FIG. 7) corresponds), or the small-brief folding blade positions of FIG. 3 (to which FIGS. 15 and 16 correspond).

Figure 7:
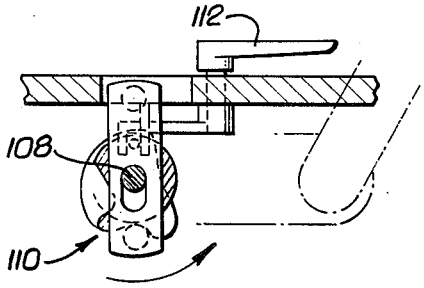

Each connecting mechanism 110 is controlled by a manually operable handle 112, which is shown in the large-brief folding position in FIG. 7, and in the small-brief folding position in FIGS. 15 and 16.

Since various structures may be used for such things as the rod mounting means 100, the drive trains 102, the drive means 104, the drive trains 106, the connecting mechanisms 110, and the like, the details thereof will not be described specifically herein. As will be apparent, various other structures can be used to achieve the sequential movements of the folding blades 94 hereinbefore discussed.

Extracting and Rolling Apparatus 42

Figure 19:
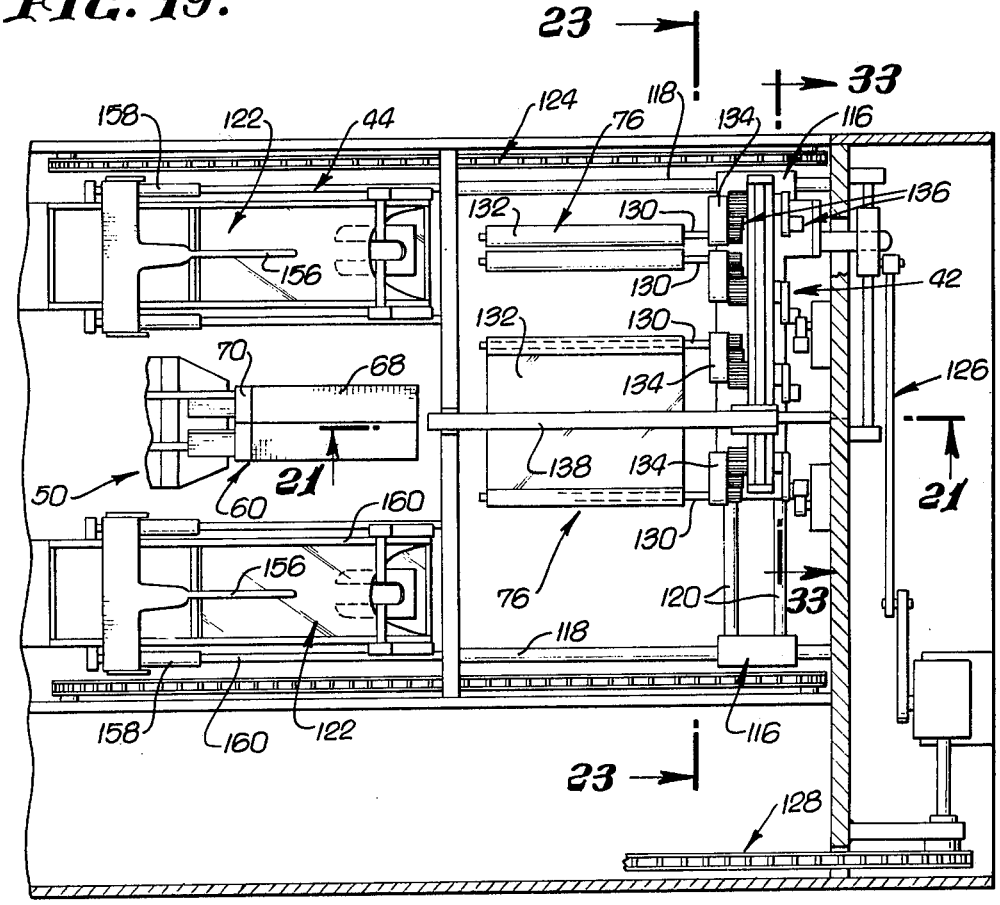
FIG. 19 is a view taken as indicated by the arrowed line 19—19 of FIG. 18.
Figure 21:
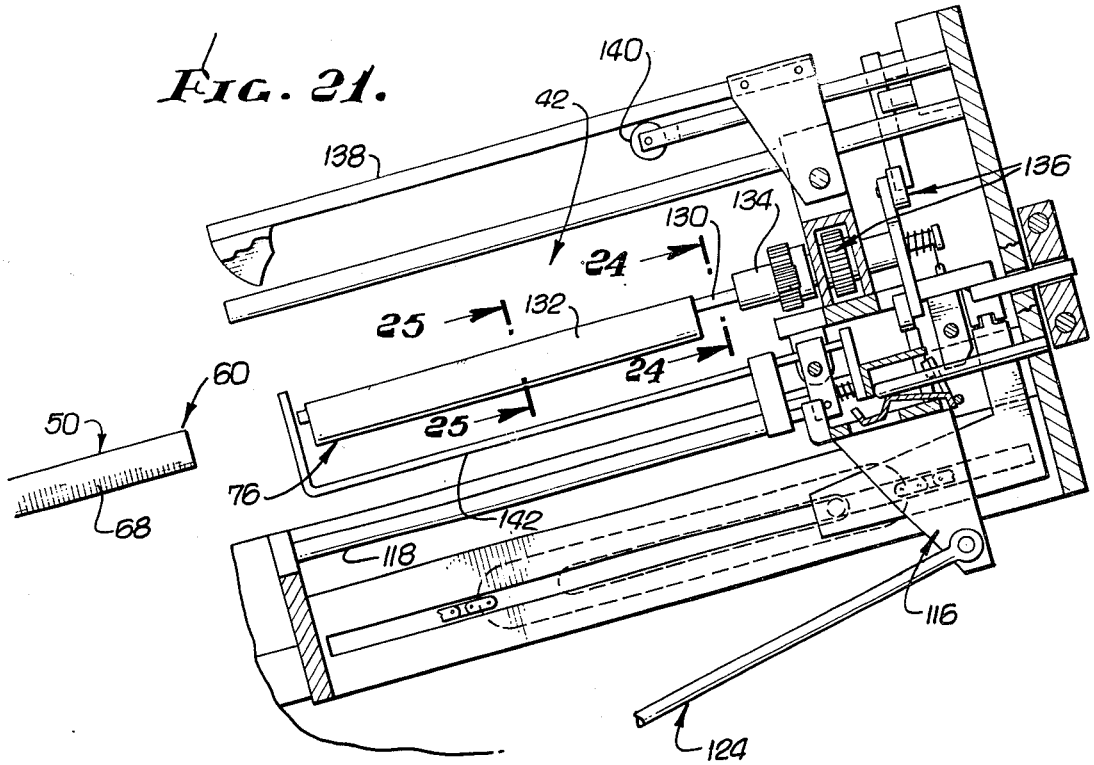
FIGS. 21 and 22 are views taken as indicated by the arrowed line 21—21 of FIG. 19, but showing various parts in different operating positions.
Figure 22:
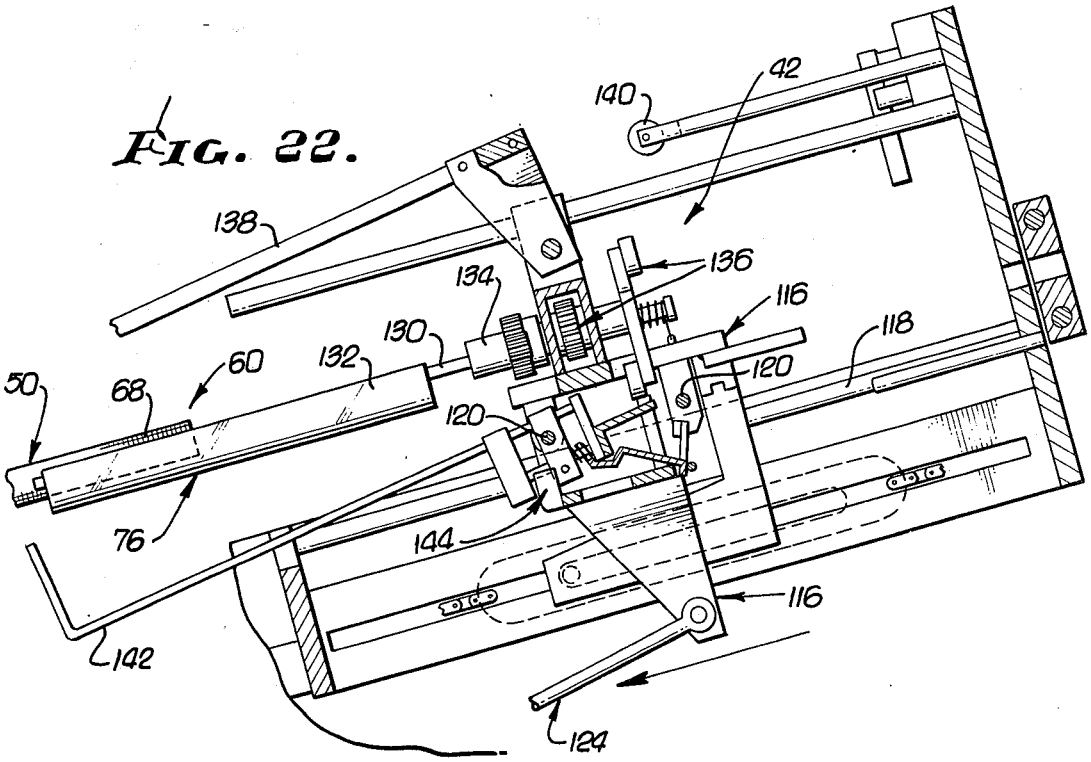
Figure 23:
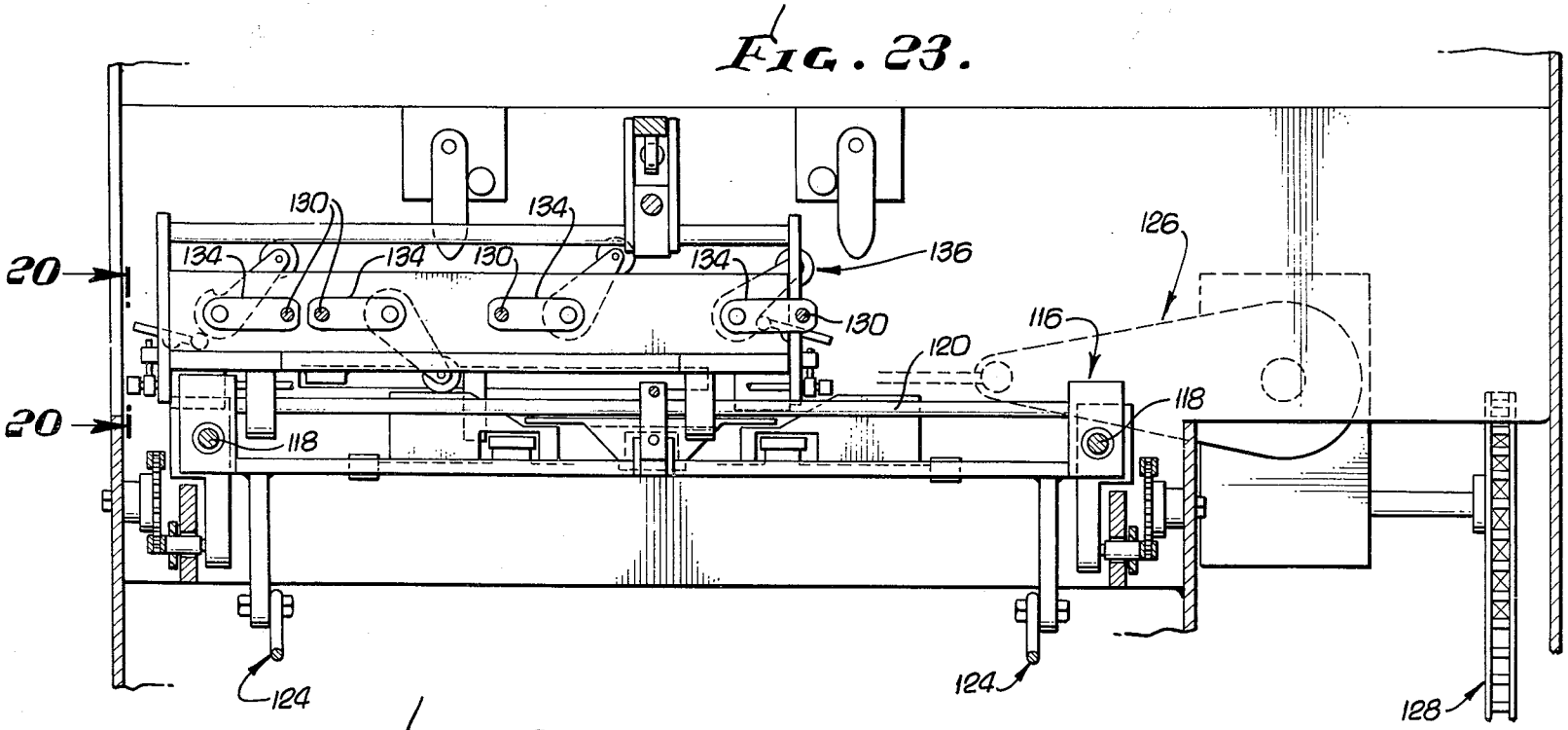
FIG. 23 is a view taken as indicated by the arrowed line 23—23 of FIG. 19.
Figure 37:
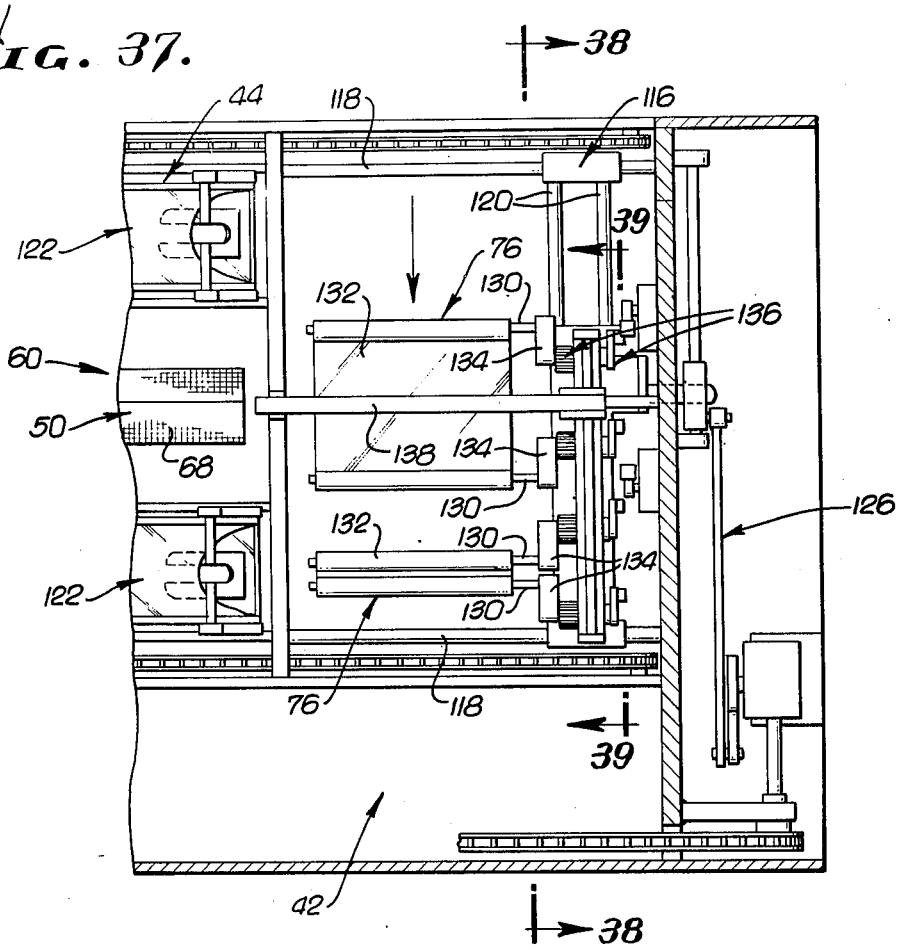
FIG. 37 is a view similar to FIG. 19, but again showing various parts in different operating positions.
Figure 39:
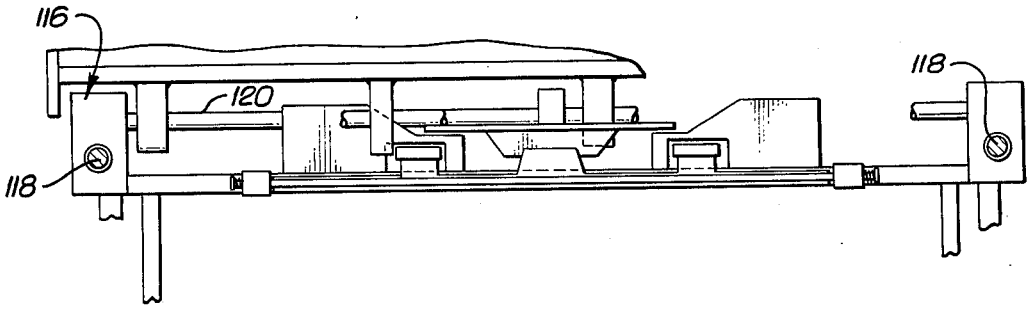

As perhaps best shown in FIGS. 19 and 37, the folded brief extracting and rolling apparatus 42 comprises two of the extracting and rolling means 76 mounted on a carriage 116 in laterally spaced relation. The carriage is movable longitudinally along guides 118 to move one or the other of the extracting and rolling means 76 into and out of the extraction station 60. The two extracting and rolling means 76 are also movable laterally of the carriage 116 on transverse guides 120 to align one or the other of the extracting and rolling means 76 with the extraction station 60.

As will be described in considerably more detail hereinafter, the packaging apparatus 44 includes two laterally spaced bagging means 122 forwardly of the extracting and rolling means 76 and located on opposite sides of the extraction station 60. The extracting and rolling means 76 are laterally spaced apart a distance equal to the lateral spacing of each of the bagging means 122 from the particular folding unit 50 which is in the extraction station 60 at any particular moment. Thus, as will be clear from FIGS. 19 and 37 of the drawings, when one of the extracting and rolling means 76 is in alignment with the extraction station 60, the other is in alignment with one of the bagging means 122. Conversely, when the other extracting and rolling means 76 is in alignment with the extraction station 60, the first extracting and rolling means 76 is in alignment with the other of the two bagging means 122.

The carriage 116 may be moved longitudinally back and forth along its guides 118 by any suitable means 124. Similarly, the two extracting and rolling means 76 may be moved back and forth laterally relative to the carriage 116 along the transverse guides 120 by any suitable means 126. Consequently, the longitudinal displacement means 124 for the carriage 116 and the lateral displacement means 126 for the extracting and rolling means 76 will not be described in detail herein, being fully shown in the drawings. Suffice it to say that the displacement means 124 and 126 are driven in timed relation with the folding apparatus 40 by drives 127 and 128 connected to the main drive means 48, the drives 127 and 128 being shown in FIGS. 18 and 19, respectively.

Extracting and Rolling Means 76

The two extracting and rolling means 76 are identical and, consequently, only one of them will be considered in detail, primarily with reference to FIGS. 19, 25, 27, 30, 31 and 37.

Basically, each extracting and rolling means 76 comprises two transversely spaced, parallel rods or shafts 130 which are positionable on opposite sides of the particular folding unit 50 in the extraction station 60 upon movement of the carriage 116 forwardly toward the extraction station. A flexible web 132 extends between the shafts 130 and has lateral edges respectively secured to the shafts, the web being adapted to engage the folded brief 68 on the particular folding unit 50 in the extraction station 60. This web may be made of any suitable material, such as an appropriate plastic.

Figure 25:
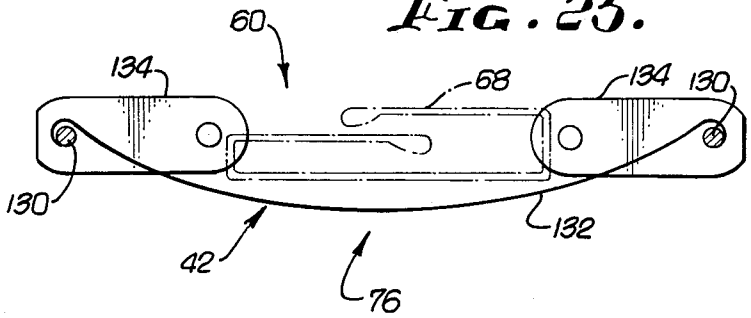
FIGS. 24 and 25 are views taken as indicated by the arrowed lines 24—24 and 25—25 of FIG. 21.
Figure 24:
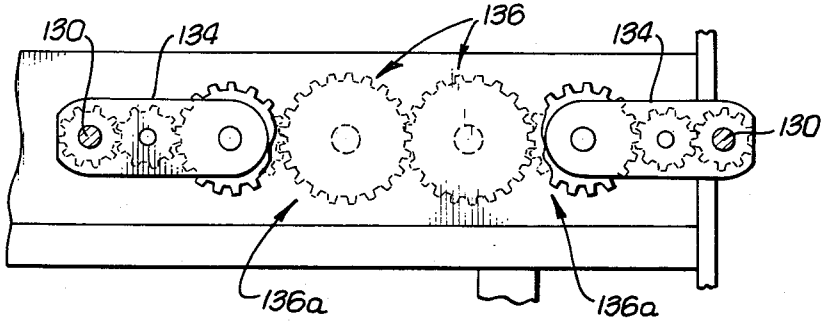
Figure 30:
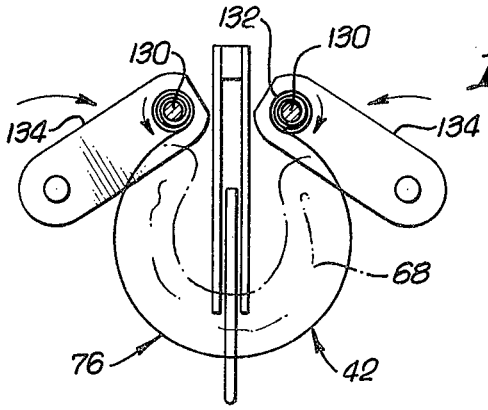
FIGS. 30 and 31 are views respectively taken along the arrowed lines 30—30 and 31—31 of FIGS. 28 and 26, and showing the components of a brief rolling means of the invention in successive operating positions to roll a transversely and longitudinally folded brief into substantially a cylinder.
Figure 31:
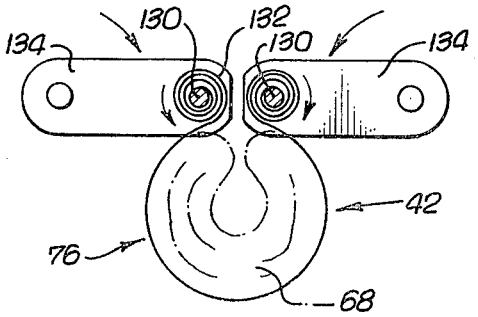
Figure 28:
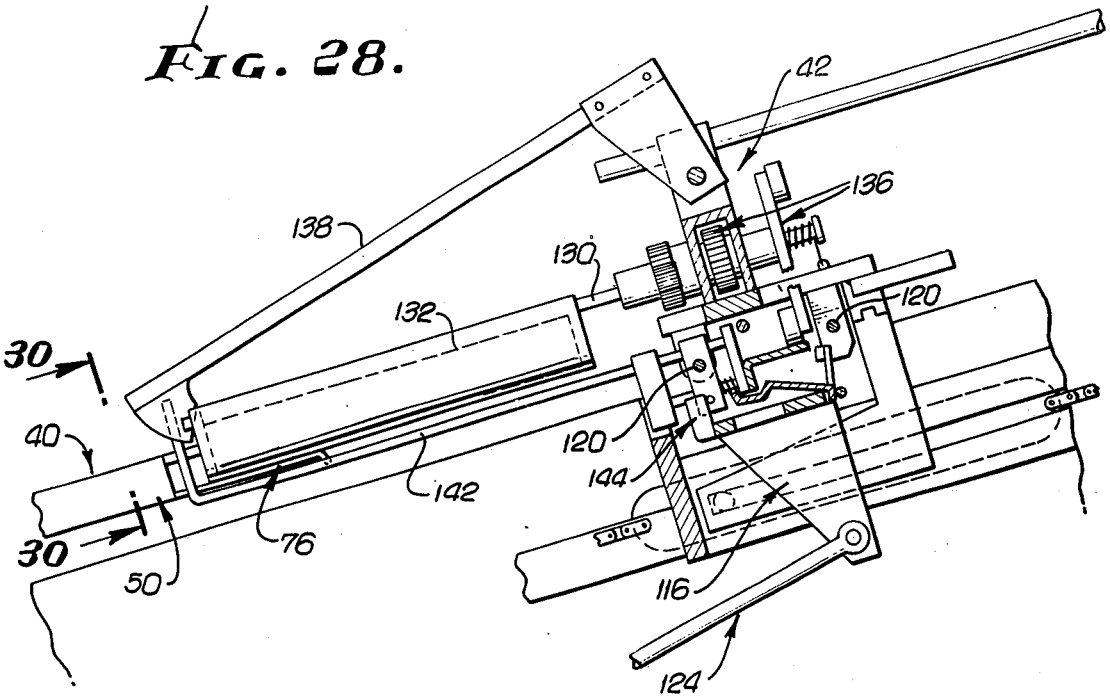
FIG. 28 is a view similar to FIG. 22, but again showing various parts in different operating positions.
Figure 29:
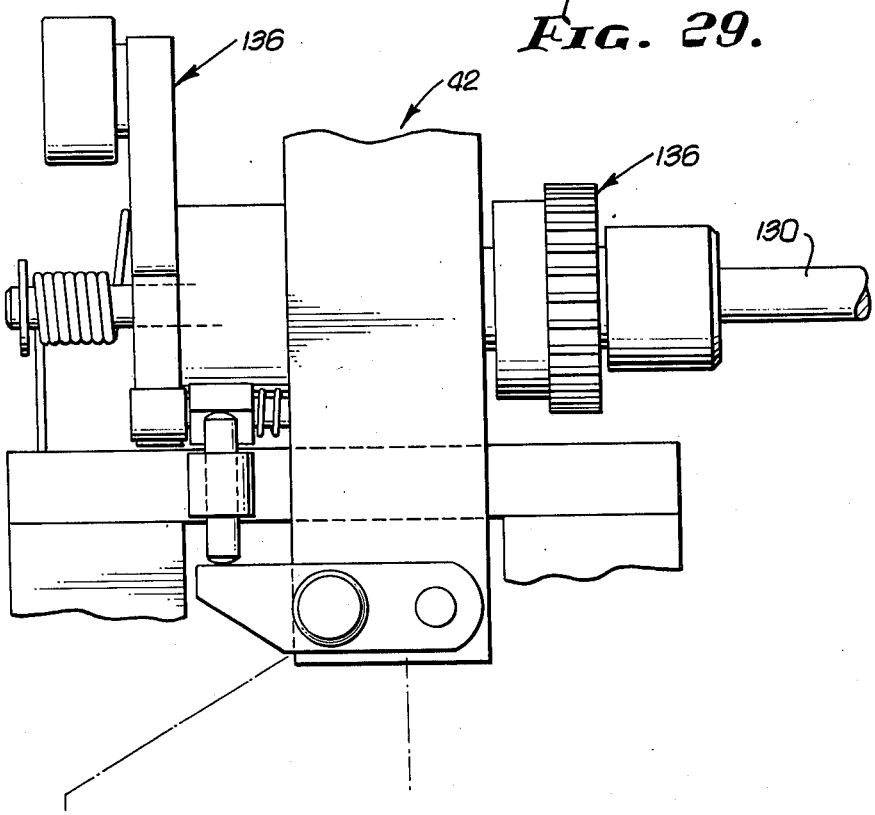
FIG. 29 is a view similar to FIG. 20, again showing various parts in different operating positions.

The two shafts 130 of each extracting and rolling means 76 are rotatable in opposite directions such as to wind the opposite edges of the web 132 thereon, as will be clear from a comparison of FIG. 25 on the one hand with FIGS. 30 and 31 on the other. Means is also provided for simultaneously swinging the shafts 130 toward each other to wrap the web 132 around the folded brief 68 on the particular folding unit 50 in the extraction station 60, as will be clear from FIGS. 30 and 31. For this purpose, the shafts are mounted on cranks 134.

Any suitable means 136 may be provided for rotating the shafts 130 of each unit 76 as indicated by the corresponding arrows in FIGS. 30 and 31, and for simultaneously swinging the shafts of each unit inwardly toward each other, as also indicated by the corresponding arrows in FIGS. 30 and 31, to wrap the web 132 around the folded brief 68 to be extracted at the extraction station 60. The means 136 are fully illustrated in the drawings and, since the invention is not limited to the particular means illustrated, they will not be described in detail herein. Suffice it to say that each means 136 closes the corresponding extraction and rolling means 76 in response to transverse movement thereof from alignment with the extraction station 60 to alignment with the corresponding bagging unit 142. For example, each means 136 may comprise a gear train 136*a,* FIG. 24, for rotating the shafts 130, and cam actuated arms 136*b,* FIGS. 33, 34, 34*a* and 36, for swinging the shafts 130 between their open and closed positions, which arms 136*b* also drive the gear train 136*a.*

Considering the operation of one of the extracting and rolling means 76, the extracting and rolling means in question is aligned with the folded brief 68 to be extracted from a folding unit 50 in the extraction station 60 with such extracting and rolling means in its "open" condition, as shown in FIGS. 19, 25 and 37. In other words, the laterally spaced edges of the web 132 are unrolled from the shafts 130 and the cranks 134 are positioned to provide the shafts 130 with their maximum spacing.

Figure 27:
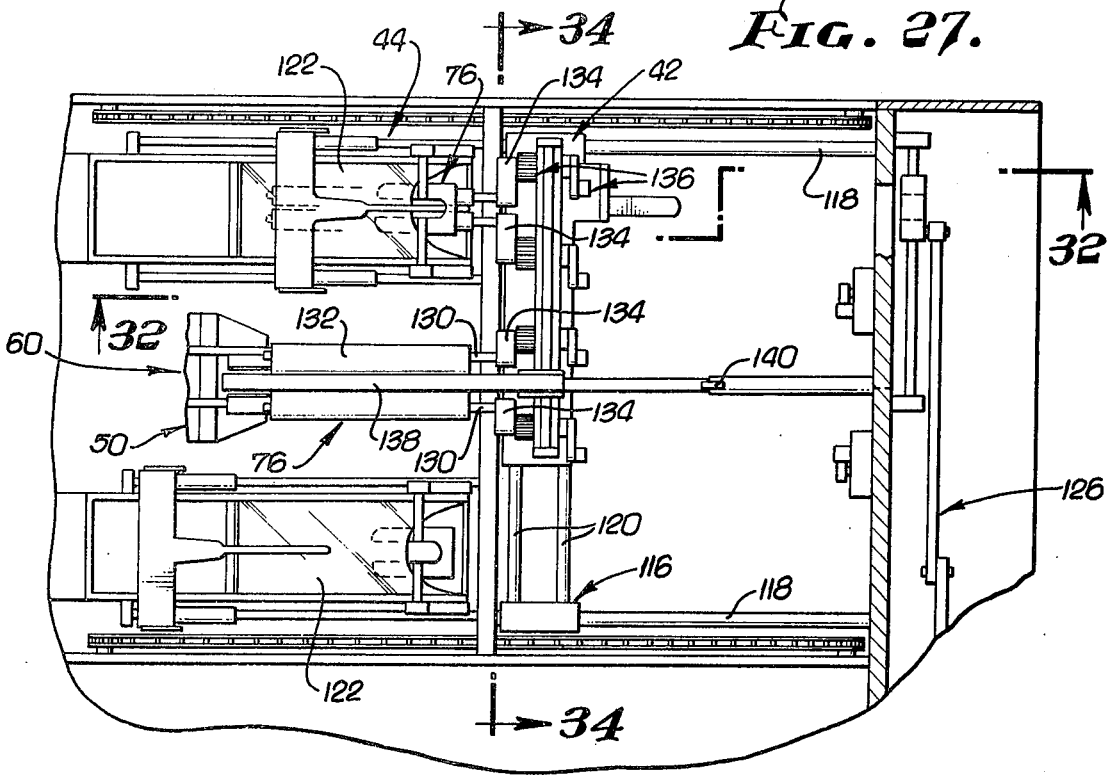
FIG. 27 is a view similar to FIG. 19, but showing various parts in different operating positions.

Then, the particular extracting and rolling means 76 in alignment with the extraction station 60 is displaced into the extraction station by longitudinally moving the carriage 116 forwardly toward the extraction station, i.e., into the position shown in FIG. 27.

As shown in FIG. 25, when one of the extracting and rolling means 76 is in the extraction station 60, the shafts 130 are at their maximum lateral spacing and the web 132 is beneath the folded brief 68 on the folding unit 50 in the extraction station. Then, the carriage 116 is retracted rearwardly, away from the extraction station 60, to extract the folded brief 68 from the corresponding folding unit 50, i.e., to pull the folded brief off the corresponding folding unit, with the folded brief resting on the web 132. The actual extraction of the folded brief 68 is effected by a pivoted, hooked extraction finger 138 which engages the waistband end 70 of the folded brief, FIG. 28, being normally held in an upper, retracted position by a roller 140, FIG. 21. Assisting the finger 138 is a lower hooked pivoted finger 142 which is normally retracted downwardly, FIG. 22, but which is elevated by means 144 into hooked engagement with the waistband end 70 of the folded brief, FIG. 28.

Then, as shown in FIGS. 30 and 31 in particular, the laterally inward movements of the shafts 130 toward each other are effected by the means 136, and the laterally spaced edges of the web 132 are wound on the shafts 130 by rotating them in opposite directions with the same means 136, all as indicated by the various arrows in FIGS. 30 and 31.

Ultimately, as shown in FIG. 31, the folded brief is tightly rolled into a substantially cylindrical configuration, with the waistband end 70 of the brief at one end of such cylindrical configuration. As will be described subsequently, the tightly rolled brief 68 is ultimately inserted into a bag, preferably a transparent plastic bag, waistband-end first, in one of the bagging means or units 122. The waistband-end-first insertion of each tightly rolled brief 68 is effected readily, as will be described, because of the fact that the waistband end 70 of each tightly rolled brief 68 faces the bagging means or unit 122 with which it is aligned, as will be clear from FIGS. 19 and 37. As previously discussed, this waistband-end-first insertion is an important feature of the invention.

Packaging Apparatus 44

The packaging apparatus 44 comprises the two bagging means or units 122, which are identical. Consequently, only one of the units will be considered, primarily with reference to FIGS. 19, 26, 32 and 35.

Figures 26, 34A:
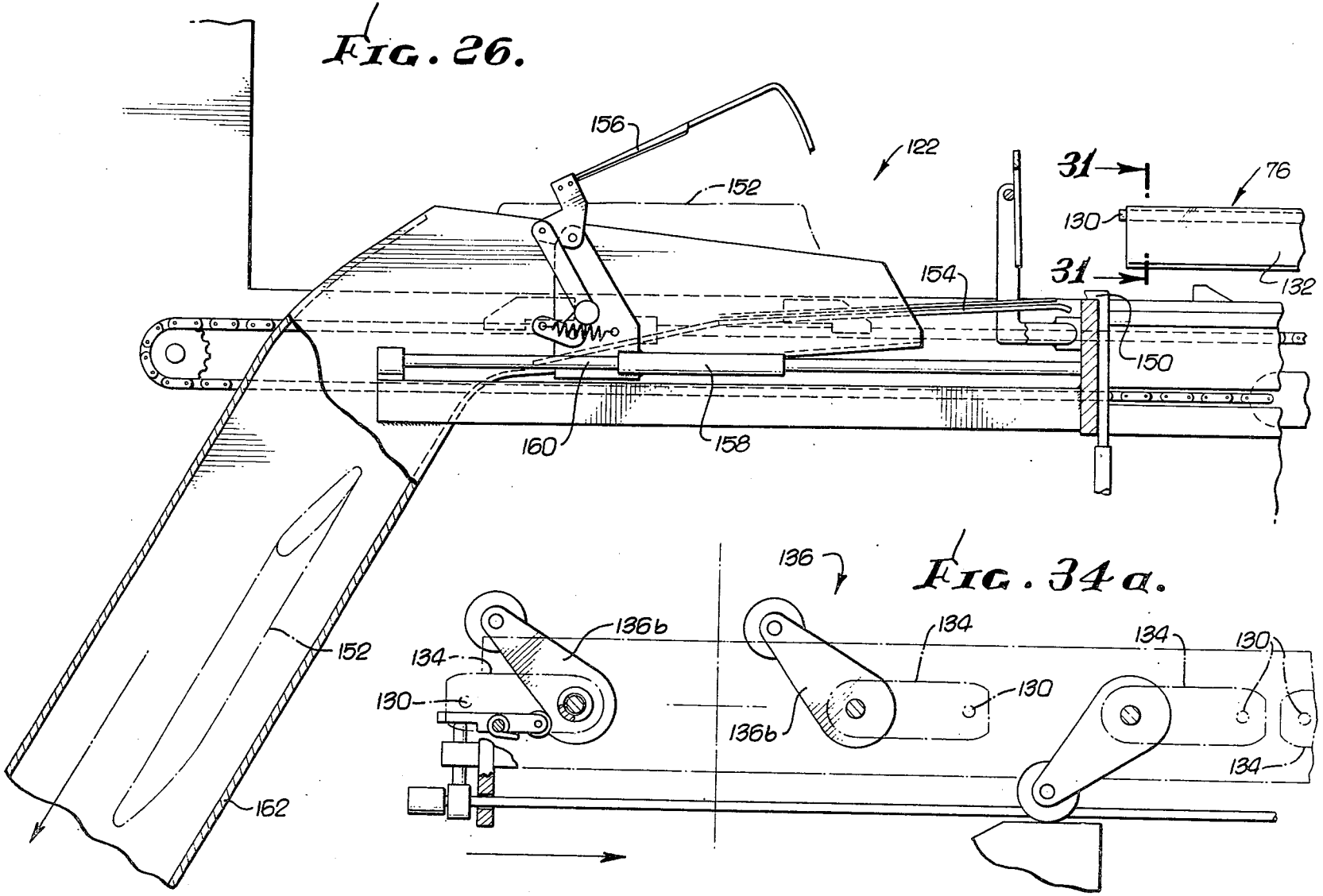
FIG. 26 is a view duplicating a portion of FIG. 18 on a larger scale and in more detail, and shows a packaging means forming part of the over-all system of the invention.
FIGS. 33, 34, 34*a* and 36 are views taken along the arrowed line 33—33 of FIG. 19, and showing various parts in different operating positions.
Figure 32:
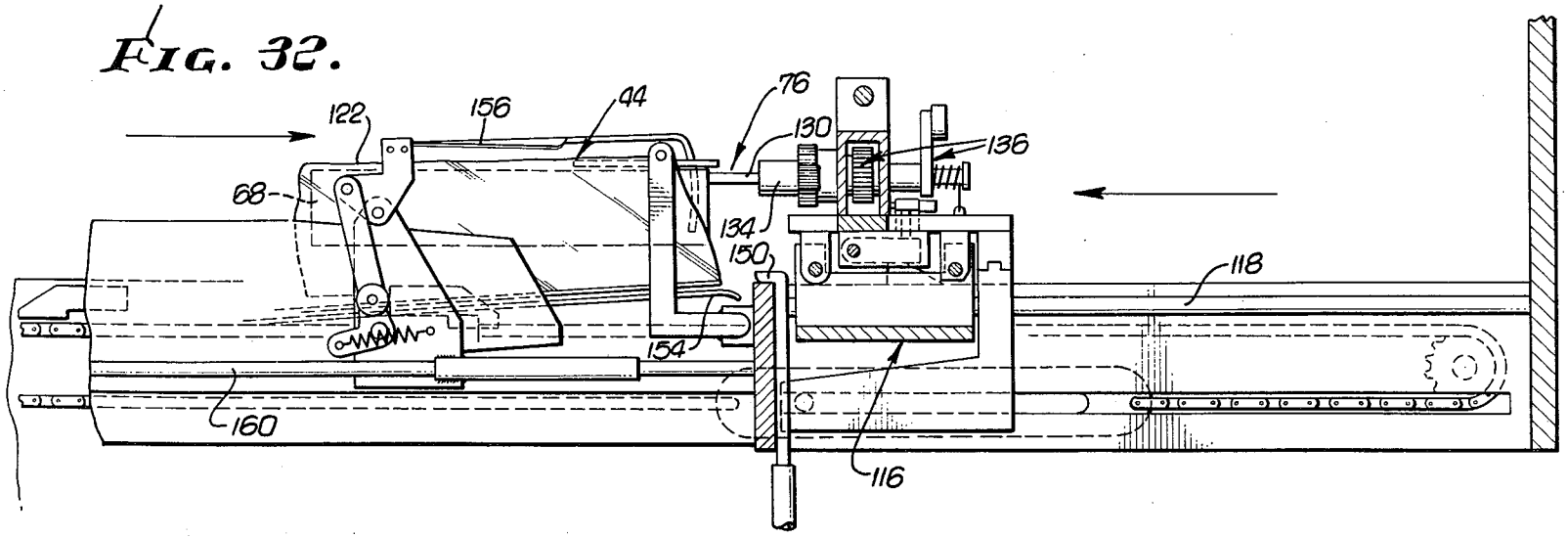
FIGS. 32 and 35 duplicate a portion of FIG. 26, and show various parts associated with packaging the folded and rolled brief in different operating positions.
Figure 34:
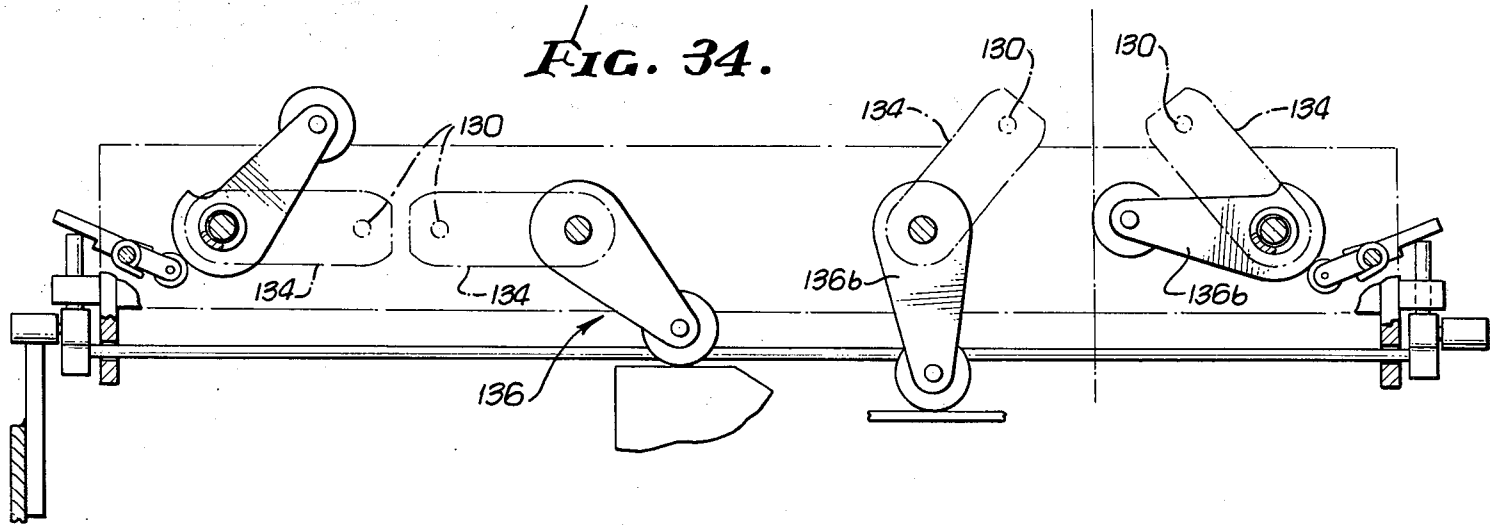
Figure 35:
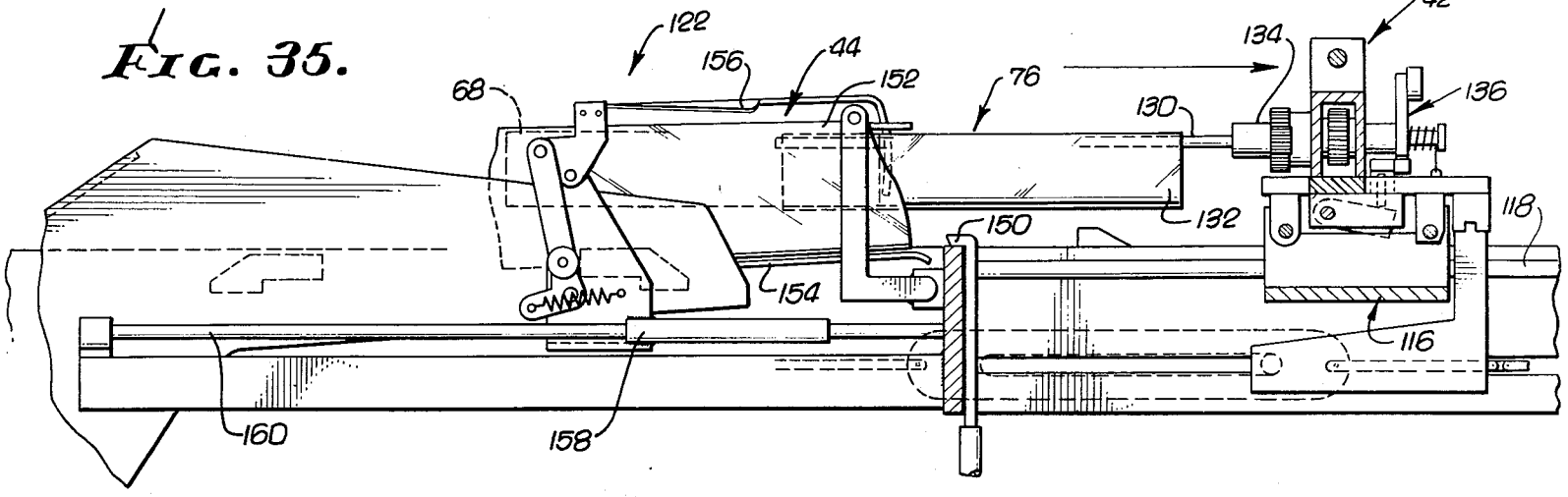
Figure 33:
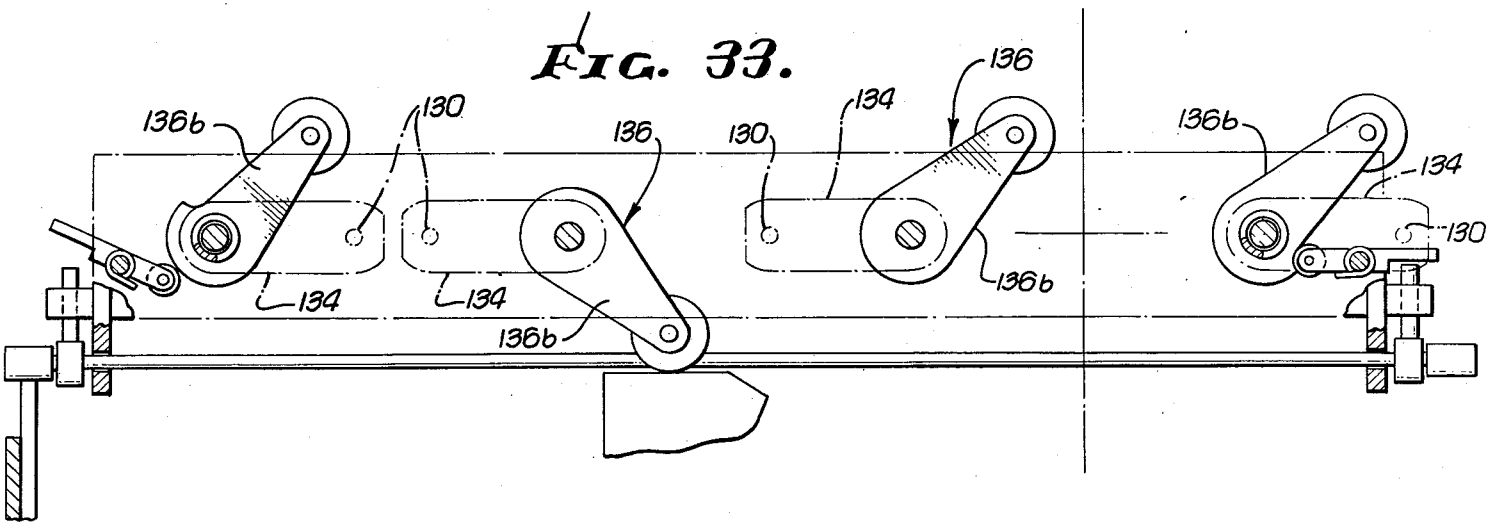
Figure 38:
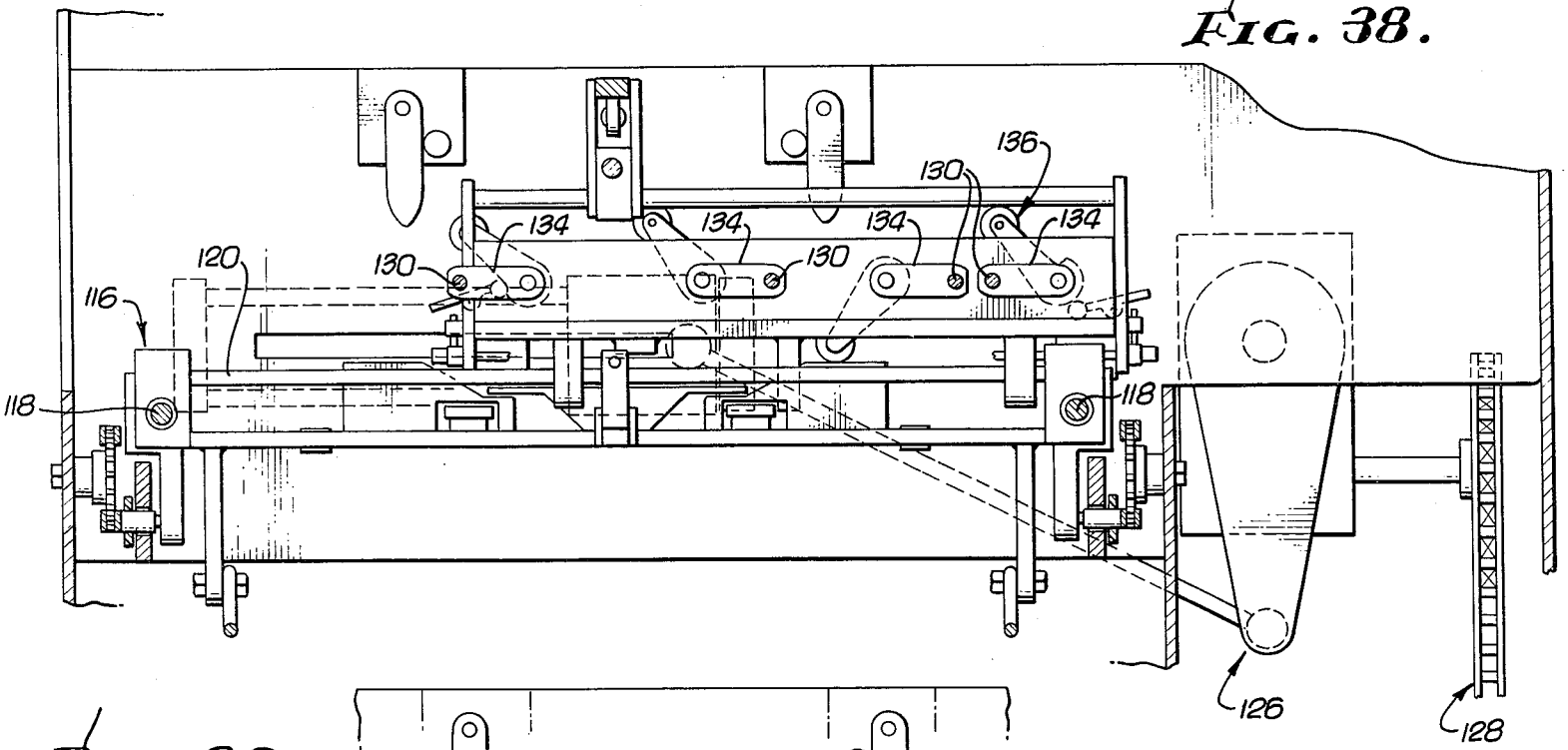
FIGS. 38 and 39 are views respectively taken along the arrowed lines 38—38 and 39—39 of FIG. 37 of the drawings.
Figure 36:
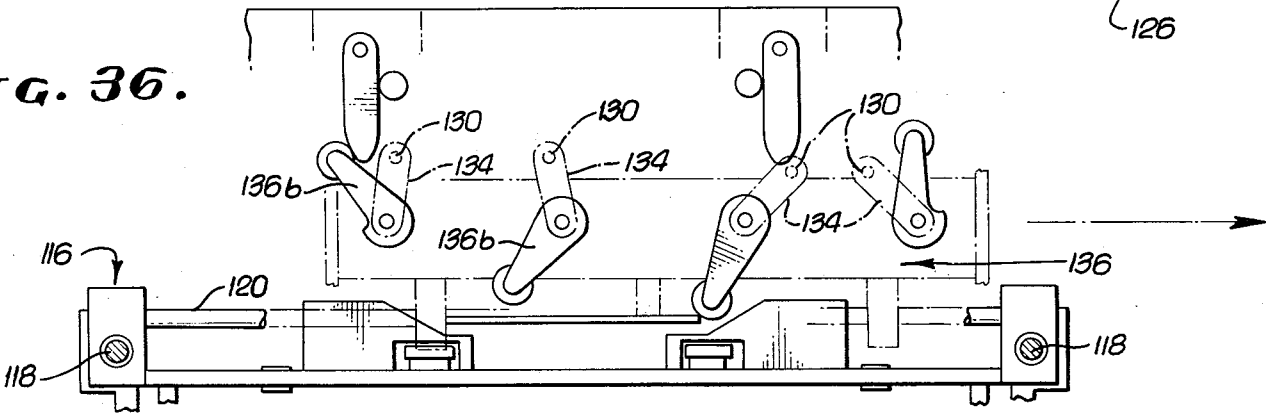

As a folded and rolled brief 68 carried by one of the extracting and rolling units 76 approaches the corresponding bagging unit 122, FIGS. 19, 26 and 37, an air jet 150, FIGS. 26, 32 and 35, opens a bag 152, preferably a transparent plastic bag, carried on a bag support 154, bags being suitably supplied to the bag support. With the bag 152 held open by the air jet 150, it is a simple matter for the corresponding rolling unit 76 to insert the folded and rolled brief 68 into the inflated bag waistband-end first, which is an important feature of the invention since it greatly facilitates brief insertion into the inflated bag. FIGS. 32 and 35 show the folded and rolled brief 68 fully inserted into the bag 35.

FIG. 35 also shows the extracting and rolling unit 76 in the process of being moved away from the bagging means 122, by rearward movement of the carriage 116. To strip the folded and rolled brief 68 from the unit 76, and to retain it in the bag 68, a pivoted hooked finger 156 descends to engage the rearward end of the brief, as shown in FIGS. 32 and 35. FIG. 32 shows the position of the finger 156 prior to beginning of the stripping action, while FIG. 35 shows the stripping action nearly completed.

The finger 156 is mounted on a slide 158, FIGS. 19, 26, 32 and 35, which is suitably moved to the left, as viewed in the drawings, along guides 160 to discharge the bag 152 containing the folded and rolled brief 68 into a downwardly inclined discharge chute 162, FIGS.

18 and 26. The discharge chutes 162 of the two bagging units 122 lead to a takeaway conveyor 164.

Although an exemplary embodiment of the invention has been disclosed for illustrative purposes, it will be understood that various changes, modifications and substitutions may be incorporated in such embodiment without departing from the invention as hereinafter claimed.

I claim as my invention:

1. A method of folding a man's brief, or the like, having a waistband, comprising the steps of:

a. making a transverse fold in the brief;

b. making spaced, parallel longitudinal folds in the transversely folded brief; and c. then rolling the transversely and longitudinally folded brief into a substantially cylindrical configuration having an axis substantially parallel to the longitudinal folds and with the waistband at one end.

2. The method set forth in claim 1 including the additional step of packaging the brief by inserting the transversely and longitudinally folded and rolled brief into a bag with the waistband end of the cylindrical configuration being inserted first.

* * * * *